United States Patent [19]

Chen et al.

[11] Patent Number: 4,922,047

[45] Date of Patent: May 1, 1990

[54] PROCESS FOR PRODUCTION OF TRACTION FLUIDS FROM BICYCLIC AND MONOCYCLIC TERPENES WITH ZEOLITE CATALYST

[75] Inventors: Catherine S. H. Chen, Berkeley Heights, N.J.; Thomas R. Forbus, Jr., Newtown, Pa.

[73] Assignee: Mobil Oil Corporation, New York, N.Y.

[21] Appl. No.: 288,191

[22] Filed: Dec. 22, 1988

[51] Int. Cl.[5] ..... C07C 13/00; C07C 175/00; C10M 165/00

[52] U.S. Cl. ..... 585/12; 585/20; 585/362

[58] Field of Search ..... 585/12, 20, 362

[56] References Cited

U.S. PATENT DOCUMENTS

| | | | |
|---|---|---|---|
| 2,249,112 | 7/1941 | Carmody | 585/20 |
| 3,608,385 | 1/1969 | Duling et al. . | |
| 4,165,301 | 8/1979 | Wiegers et al. | 252/122 |
| 4,329,529 | 5/1982 | Nambu | 585/20 |
| 4,517,399 | 5/1985 | Chester et al. . | |
| 4,520,221 | 5/1985 | Chen . | |
| 4,524,232 | 6/1985 | Chester et al. . | |
| 4,547,613 | 10/1985 | Garwood et al. . | |
| 4,556,503 | 12/1985 | Tsubouchi et al. | 585/20 |
| 4,658,079 | 4/1987 | Chen . | |
| 4,665,250 | 5/1987 | Chu et al. . | |

OTHER PUBLICATIONS

"Camphene Dimers and Trimers", (1974), Matsubara et al., Chem. Absts., vol. 80, #133652.

Camphene Dimer, (1971), Chem. Absts., vol. 76, #34432, Matsubara et al.

Uses of Terpene Dimers in Perfumery Processes and Products, (1979), Wiegers et al., Chem. Absts., vol. 92: #82251.

Studies of Dimeric Substances Produced by the Action of Protonic Acids on Monocyclic Terpenes, (1982), Klyuev et al., Chem. Absts., vol. 97:163268.

Joseph P. Kennedy and Ernest Marechal, Carbocationic Polymerization, Industrial Processes and Technological Aspects, pp. 491 to 498, 1982.

*Primary Examiner*—H. M. S. Sneed
*Assistant Examiner*—J. Saba
*Attorney, Agent, or Firm*—Alexander J. McKillop; Charles J. Speciale; L. G. Wise

[57] ABSTRACT

Bicyclic and monocyclic terpenes are oligomerized by contact over a zeolite catalyst to produce high boiling lube oil traction fluid having a high traction coefficient. The traction fluid comprises dimers, trimers and tetramers of the bicyclic and monocyclic terpenes. The lube oil is catalytically hydrogenated to obtain a saturated cycloparaffin hydrocarbon oil traction fluid.

20 Claims, No Drawings

PROCESS FOR PRODUCTION OF TRACTION FLUIDS FROM BICYCLIC AND MONOCYCLIC TERPENES WITH ZEOLITE CATALYST

CROSS-REFERENCE TO RELATED APPLICATIONS

This application is related to copending application Ser. No. 888,915 now U.S. Pat. No. 4,762,635 entitled High Traction Synthetic Hydrocarbon Fluids, filed July 24, 1986 and to copending application Ser. No. 292,795 entitled Process For Production Of Traction Fluids From Light Olefins With Zeolite Catalyst, filed 1/3/89.

1. Field of the Invention

The present invention relates to a catalytic process for converting bicyclic and monocyclic terpenes to a lube oil traction fluid having a high traction coefficient.

In particular, the present invention relates to a process for converting bicyclic and monocyclic terpenes by contacting them over a zeolite catalyst under oligomerization conditions to produce a high boiling lube oil traction fluid having a high traction coefficient. The traction fluid comprises dimers, trimers and tetramers of the bicyclic and monocyclic terpenes.

The lube oil is catalytically hydrogenated to obtain a saturated hydrocarbon traction fluid.

2. Discussion of the Prior Art

The bicyclic and monocyclic terpenes are present in natural products such as essential oils and resins and are readily and economically available natural materials.

Developments in zeolite catalysis and hydrocarbon conversion processes have created interest in utilizing olefinic feedstocks for producing gasoline, diesel fuel, lubricating oils, etc.

The catalytic conversion of light aliphatic olefins by contact with zeolite catalyst to produce a lubricating oil is generally known. For example, Chester et al U.S. Pat. No. 4,517,399 discloses a process for the production of high viscosity lubricating oil by reacting olefins over ZSM-5 type zeolite catalyst at elevated temperatures and pressures. Chen U.S. Pat. No. 4,520,221 discloses a process for the production of high viscosity index lubricating oil by inactivating the surface of a ZSM-5 type catalyst and then reacting olefins over the catalyst at elevated temperatures and pressures. Chester et al U.S. Pat. No. 4,524,232 discloses a two stage process for the production of high viscosity index lubricating oil which comprises contacting in a first stage olefins over a small pore zeolite catalyst and recovering a liquid product, and in a second stage contacting the liquid product over an intermediate pore size zeolite catalyst. Garwood et al U.S. Pat. No. 4,547,613 discloses a two step process for converting light olefins to high viscosity index lubricating oil which comprises first contacting a ZSM-5 type zeolite catalyst with a $C_3$ to $C_6$ olefin to condition the catalyst and then contacting the conditioned catalyst with an olefin stream containing $C_2$ to $C_{16}$ olefins at elevated temperatures and pressures. Chen U.S. Pat. No. 4,658,079 discloses a process for producing high viscosity index lubricating oil which comprises inactivating the surface of an HZSM-5 type catalyst with an organophosphorus compound and then contacting the inactivated catalyst with a lower olefin at elevated temperatures and pressures. Chen et al U.S. Pat. No. 4,665,250 discloses a process for converting light olefins to gasoline, distillate range hydrocarbons and a 650° F.+ lube fraction which comprises contacting a lower olefin feedstock with ZSM-48 zeolite catalyst at elevated temperatures and pressures.

Regular lubricating oils processes are not suitable as traction fluids because of their low traction coefficients, that is because of their relatively high slippage.

Dulling et al U.S. Pat. No. 3,608,385 disclose a friction drive machine and a method of making a high traction coefficient fluid for use in the friction drive machine. The traction fluid is made by the catalytic polymerization of styrene, alpha-methyl styrene, beta-methyl styrene, or by the catalytic polymerization of propylene or butylene. The polymeric materials obtained can be used alone or mixed together as traction fluids. Various catalyst systems are disclosed. For example, for styrene polymerization conventional aqueous sulfuric acid can be used, and for butylene polymerization acid catalyst such as $AlCl_3$ or $BF_3$ can be used, or Ziegler catalyst can be used.

Kennedy and Marechal, Carbocationic Polymerization, pages 491 to 498, article discloses polyterpene resins prepared from $\alpha$-pinene and $\beta$-pinene.

The above mentioned prior art patents and article are incorporated herein by reference thereto.

A commercial available fraction fluid marketed under the name of Santotrac 50 by Monsanto has a branched and cyclic type structure and a high tractión coefficient but is very expensive. Other commercially available traction fluids based on naphthenic stocks though not expensive have relatively low traction coefficients.

It has now been discovered that high boiling lube oil traction fluid can be produced from bicyclic and monocyclic terpenes by contact over a zeolite catalyst under oligomerization conditions to obtain a high traction coefficient lube oil in an economical and efficient manner.

The traction coefficient of the lube oil is generally not affected by hydrogenating the oil to remove olefinic unsaturation. The hydrogenation of the traction fluid also improves the stability of the oil.

OBJECTS

It is an object of the present invention to produce a high traction coefficient lube oil in an efficient and economical manner.

It is a further object of the present invention to produce a high traction coefficient lube oil from bicylic and monocyclic terpenes, by a process which comprises contacting the bicyclic and monocyclic terpenes over a zeolite catalyst under oligomerization conditions to obtain the lube oil.

It is a further object of the present invention to obtain from the bicyclic and monocyclic terpene feed a highly branched and cyclic oligomer product boiling at 650° F.+ which has a high traction cofficient and is suitable for use in a traction drive machine.

SUMMARY OF THE INVENTION

The present invention relates to a catalytic process for converting bicyclic and monocyclic terpenes to a lube oil having a high traction coefficient.

The present invention particularly relates to a process for converting bicyclic and monocyclic terpenes by contacting them over a zeolite catalyst under oligomerization conditions to produce a high boiling lube oil having a high traction coefficient.

The lube oil is catalytically hydrogenated to obtain a saturated cycloparaffin hydrocarbon oil traction fluid.

The hydrogenation of the lube oil saturates olefinic unsaturation, increases oxidative stability of the oil and generally does not affect the traction coefficient.

The present invention further relates to a method of transmitting torque or tractional forces from a tractional driving element to driven element through a traction fluid comprising using as said traction fluid the lube oil traction fluid prepared in accordance with the present invention.

The present invention further relates to a method of transmitting torque or tractional forces from a tractional driving element to a driven element through a traction fluid comprising using as said traction fluid a composition comprising the high boiling lube oil traction fluid of the present invention having a high traction coefficient prepared by the catalytic oligomerization of bicyclic and monocyclic terpenes by contact with a zeolite catalyst to obtain a 600° F.+ lube oil and hydrogenating the oil.

The present invention also relates to an improved method of operating a traction drive wherein the improvement comprises using as the traction fluid a high boiling lube oil of the present invention having a high traction coefficient.

The bicyclic terpenes that can be used in accordance with the present invention include alpha-pinene, beta-pinene and camphene. The monocyclic terpenes that can be used in accordance with the present invention include alpha-terpinene, beta-terpinene and limonene.

The high boiling lube oil traction fluids obtained include dimers, trimers and tetramers of the bicyclic and monocyclic terpenes. The dimers can be used alone or can be used mixed with trimers and/or tetramers.

High traction coefficient fluids give superior performance in traction drives. A traction drive transfers force from one rotating shaft to another through a rolling contact. The transfer is efficient if there is "minimal" slippage. This is a function of the traction coefficient which is defined as the force transmitted divided by the normal force which keeps the rolling members in contact or as being the quotient of the traction due to the transmission of the traction between the driving and driven elements and the normal force (normal load) between the driving and driven elements. Slip may be defined as being the absolute value of the quotient of the difference between the two circumferential speeds of the roller elements and the greater circumferential speed. The maximum coefficient of traction is preferably as high as possible in order to achieve maximum power transmission per unit load.

Advantages

The traction fluids of the present invention have traction coefficients equivalent to or higher than some of the traction fluids currently being commercially marketed.

The traction fluids of the present invention are made from relatively inexpensive natural material bicyclic and monocyclic terpenes in an efficient and economical manner.

DETAILED DESCRIPTION OF THE INVENTION

Traction Drive Transmission

There is a multitude of designs for continuously variable transmissions (CVT's) of which approximately ten of the "traction drive" type have been commercialized. CVT's can be used to give a wide range of output speeds for a single input speed, which is a useful feature for industrial drives, or to allow automotive engine speed to be selected for maximum efficiency based upon required torque rather than required output speed, which could potentially improve fuel economy by up to 30%.

A traction drive may be considered a transmission without gear teeth. The torque is transmitted through the thin lubricant film generated between the rolling elements of the drive; and since there are no teeth, the ratio need not be fixed and can be designed to vary continuously. Fluids appropriate for traction drives are those which have high shear strength at the high contact pressures encountered. The maximum torque that can be transmitted is determined by the fluid's peak traction coefficient (traction force diveded by contact load), which is proportional to the fluid's shear strength at the contact pressure and temperature.

The contact load required for a given torque can be reduced by using fluids with a high traction coefficient. This in turn contributes to longer roller fatigue life which is inversely proportional to the third power of the load. Suitable fluids, known as traction fluids, must be able to lubricate the rollers in addition to transmitting torque. Traction drives are usually operated at high speed to maximize power (torque×speed) for a given torque and low viscosity fluids are used to reduce churning losses and heating.

Traction force is the response of the fluid to the strain or strain rate caused by small speed differences between the bounding surfaces of contact. At the high pressures encountered, many lubricants behave as elastic-plastic solids rather than viscous liquids and the highest traction force that can be generated is a function of the maximum shear stress the solidified fluid can sustain before plastic strain occurs.

From traction force measurements in a point contact traction rig, an average value of the maximum shear stress is determined for a fluid at a range of pressures. Plots of maximum average shear stress against pressure have been found to be linear at high pressures for most fluids studied so far and for the high traction fluids remain linear throughout the pressure range used. Linearity of such a plot is a characteristic of plastic materials sheared under compression.

Hydrocarbon Feed

The feed to the process of the present invention can comprise the natural hydrocarbons present in essential oils and resins. The feed to the process of the present invention comprises bicyclic and monocyclic terpenes. Suitable bicyclic terpenes include alpha-pinene, beta-pinene and camphene. Suitable monocyclic terpenes include alpha-terpinene, beta-terpinene and limonene.

The structural formulas for representative bicyclic and monocyclic terpenes are given below.

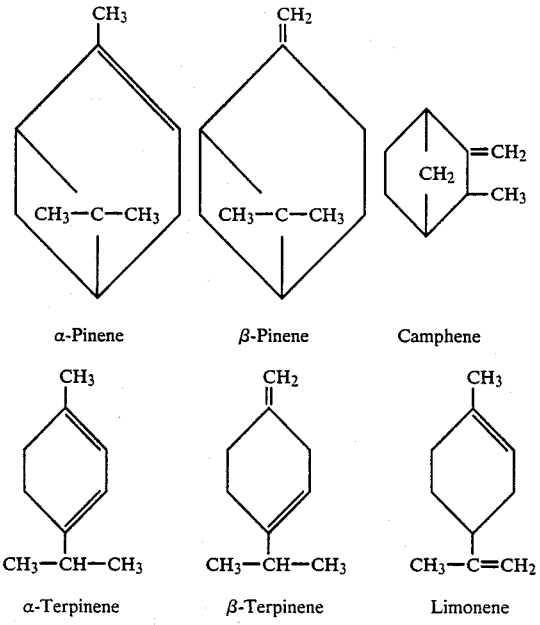

In another embodiment of the present invention the bicyclic or monocyclic terpene feed can be mixed with a light olefin, such as propylene and/or butylene and the terpene and olefin copolymerized by contact with the zeolite catalyst to obtain a 650° F.+ lube oil traction fluid.

The terpene and light olefin can be mixed at a mole ratio of terpene to propylene and butylene of 1:4 to 4:1, preferably 1:3 to 3:1 and more preferably 1:2 to 2:1, for example about 1:1.

The terpenes can be used alone or mixed. The propylene and butylene can be used alone or mixed. The mole ratios are based on total amount of terpenes and total amount of light olefins, such as propylene and butylene.

Description of Catalyst

Recent developments in zeolite technology have provided a group of large, medium and small pore siliceous materials having similar pore geometry. Among these the ZSM-5 type catalyst is readily available. These are usually synthesized with Bronsted acid active sites by incorporating a tetrahedrally coordinated metal, such as Al, Ga, B or Fe, within the zeolitic framework. The medium pore zeolites are favored for acid catalysis; however, the advantages of ZSM-5 structures may be utilized by employing highly siliceous materials or crystalline metalosilicate having one or more tetrahedral species having varying degrees of acidity. ZSM-5 crystalline structure is readily recognized by its X-ray diffraction pattern, which is described in U.S. Pat. No. 3,702,866 Argauer et al.

The oligomerization catalysts preferred for use herein include the medium pore (i.e. about 5–7 A) shape-selective crystalline aluminosilicate zeolites having a silica-to-alumina ratio of at least 12, a constraint index of about 1 to 12 and acid cracking activity of about 1–200. In the reactor bed the catalyst may have an apparent activity (alpha value) of about 1 to 300 under the process conditions to achieve the desired conversion reaction.

Representative of the ZSM-5 type zeolites are ZSM-5, ZMS-11, ZSM-12, ZSM-22, ZSM-23, ZSM-34, ZSM-35 and ZSM-38. ZSM-5 is disclosed and claimed in U.S. Pat. No. 3,702,886 and U.S. Pat. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,086,186 for ZSM-34; U.S. Pat. No. 4,016,245 for ZSM-35 and U.S. Pat. No. 4,046,839 for ZSM-38. A suitable shape selective medium pore catalyst for fixed bed is a small crystal, e.g. 0.02 to 0.10 microns, H-ZSM-5 zeolite (silica:alumina ratio—70:1) with alumina binder in the form of cylindrical extrudates of about 1–5 mm. A large pore shape selective catalyst is a small crystal zeolite Beta (silica alumina ratio—40:1) with alumina binder. Zeolite Beta is described in U.S. Pat. No. 3,308,069 and is useful in the process of the present invention. There can also be used ZSM-34 which has a pore size of 4.5 to 5.2 Å. The preferred catalyst is of ZSM-5 which has a crystal size of about 0.02 to 0.10 micron. Other catalysts which can be used include a variety of small to large pore (4 to 8 Å) siliceous materials such as gallosilicates, ferrosilicates, and/or aluminosilicates disclosed in U.S. Pat. No. 4,414,413 and U.S. Pat. No. 4,417,088 and U.S. Pat. No. 3,308,069 (Re. 28,341). The above mentioned patents are incorporated herein by reference.

The members of the class of zeolites useful herein have an effective pore size of generally from about 4 to about 8 angstroms. Catalyst having high surface acidity are particularly useful in the present invention.

Suitable zeolite catalysts that are useful in the present invention have a coordinate metal oxide to silica molar ratio of 20:1 to 200:1. It is advantageous to employ a standard ZSM-5 catalyst having a silica:alumina molar ratio of 25:1 to 70:1 with an apparent alpha value of 1 to 300. Usually the zeolite crystals have a crystal size from about 0.01 to 1 microns, with 0.02–0.1 micron being preferred. The zeolite catalyst crystals can be bound with a suitable inorganic oxide, such as silica, alumina, etc. to provide a zeolite concentration of about 5 to 95 wt%. A typical catalyst comprises 25 to 65 HZSM-5 catalyst contained within a silica-alumina matrix binder and having a fresh alpha value of about 200.

The zeolite catalyst used in accordance with the present invention is not pretreated to deactivate the surface catalyst sites or pretreated to fill the catalyst pores. With regard to treatment of the zeolite catalyst to modify the catalyst activity, the catalyst of the present invention are not pretreated, that is they are unmodified.

Process Conditions

The process of the present invention is carried out using a ZSM-5 type zeolite catalyst.

The process is carried out in the liquid phase at a catalyst bed temperature of 122° to 392° F. (50° to 200° C.), preferably 167° to 392° F. (75° to 200° C.) and more preferably at a temperature of 212° to 302° F. (100° to 150° C.), and at moderate pressure, e.g. 10 to 50 psig (0.068 to 0.34 Kpa).

The bicyclic or monocyclic terpene feed, for example pinene, camphene, terpinene or limonene, or a mixture thereof, based on terpene content is fed to the reactor at a weight hourly space velocity (WHSV) of 0.05 to 5.0, preferably 0.10 to 2.0 and more preferably 0.20 to 1.0.

The residence time of the terpene feed is in contact with the catalyst can be 0.2 to 150, preferably 0.5 to 100 and more preferably 5 to 20 hrs.

The low WHSV of, for example, 0.05 to 0.5 and long catalyst residence time increase the production of dimer and trimer product, increase the traction coefficient and decrease the viscosity index of the lube oil product obtained.

Hydrocarbon Lube Oil Product

The catalytic process of the present invention converts the bicyclic and monocyclic terpenes into high boiling dimers, trimers and tetramers having $C_{20}$ to $C_{40}$ carbon atoms. The oligomers are highly branched cycloolefin products.

The unreacted $C_{10}$ monomers are separated by distillation. The remaining lube oil traction fluid boils in the range of 600° to 1000° F. (316° to 538° C.), preferably 600° To 900° F. (316° to 482° C.) and more preferably 600° to 800° F. (343° to 427° C.).

The 600° F.+ lube oil fraction can contain $C_{20}$ to $C_{40}$ carbon atoms, preferably $C_{20}$ to $C_{30}$ carbon atoms and can have a molecular weight of 280 to 560, preferably 350 to 560.

In the embodiment of the invention in which a bicyclic or monocyclic terpene is copolymerized with a light olefin such as propylene and/or butylene the same process conditions are used. The mole ratio of terpenes to olefins can be 3:1 to 1:3, preferably 2:1 to 1:2 and more preferably 1:1.

The desired lube oil copolymerized traction fluid boiling at 650° F.+ is separated from the reaction product. This traction fluid boils in the range of 650° F. to 1000° F. (343° to 538° C.), preferably 650° to 900° F. (343° to 482° C.) and more preferably 650° F. to 800° F. (343° to 427° C.).

The 650° F.+ lube oil copolymerized traction fluid can contain $C_{23}$ to $C_{40}$ carbon atoms, preferably $C_{23}$ to $C_{30}$ carbon atoms and can have a molecular weight of 322 to 560, preferably 322 to 420.

The lube oil copolymerized products obtained contain cycloolefin unsaturation and aliphatic side chain unsaturation.

The lube oil traction fluids of both of the above embodiments can have a traction coefficient of 0.090 to 0.120, preferably 0.095 to 0.120, a kinetic viscosity at 212° F. of 3 to 10 cS, preferably 3.5 to 8 cS and an ASTM viscosity index of 50 to −800, for example −50 to −600, such as −100 to −400. Lube oil traction fluids having a traction coefficient of 0.092 to 0.120 can also be used.

The Viscosity Index of an oil is an empirical number that indicates the effect of change of temperature on the viscosity of an oil. A low Viscosity Index signifies relatively large change of viscosity with temperature.

The ASTM Viscosity Index is calculated from its viscosity at 100° F. (37.8° C.) and at 210° F. (98.9° C.). The procedure for its calculation is described in ASTM Method D2270 for calculating Viscosity Index from Kinematic Viscosity.

In some of the Examples reported in the instant application for purposes of convenience the traction coefficient and the viscosity index are given for the lube oil product obtained, that is prior to hydrogenation of the lube oil product.

It is understood, however, that in the preferred embodiment of the invention the lube oil product is hydrogenated to saturate or substantially completely saturate the olefinic unsaturation to obtain saturated cycloparaffin and paraffin side chain lube oil product. The aliphatic unsaturation of the terpene and olefin copolymers is also saturated in the hydrogenation step.

The hydrogen saturated lube oil product is substantially more stable to oxidative breakdown and generally the traction coefficient is not affected. The viscosity index of the hydrogenated lube oil is about the same as the lube oil before the hydrogenation step.

The hydrogenated lube oil traction fluids produced in accordance with the invention have traction coefficients as high or higher than some commercially available synthetic hydrocarbon fluids designed for use as traction fluids.

Hydrogenation

The high boiling lube oil fraction is catalytically hydrogenated under conventional hydrogenation process conditions to obtain a saturated cycloparaffin lube oil traction fluid. The hydrogenation of the lube oil substantially increases the high temperature stability and oxidative stability of the oil and generally does not affect the traction coefficient, the kinetic viscosity or the viscosity index of the oil.

The hydrogenation is nondestructive, i.e. saturates the olefinic bonds while retaining the branching structure produced in the oligomerization and copolymerization reactions. The branched chain structure and the molecular weight of the oligomers and copolymers are retained in the hydrogenation process. Thus complete hydrogenation is accomplished without cracking or structural chain rearrangement.

The hydrogenation step can be carried out using conventional hydrogenation processes and apparatus. The hydrogenation step can be carried out at a temperature of 212° to 455° F. (100° to 235° C.), preferably 302° to 455° F. (150° to 235° C.), at a pressure of 200 to 1500 psig (1.36 to 10.2 Kpa) hydrogen, preferably 500 to 1500 psig (3.40 to 10.2 Kpa) hydrogen and at a residence time of 2 to 90 hrs, preferably 24 to 72 hrs.

Details of a mild hydrogenation treatment are disclosed in U.S. Pat. No. 4,211,640, incorporated by reference, typically using Co or Ni with W/Mo and/or noble metal catalyst. For example, a 650° F.+ lube oil can be hydrogenated using Girdler G-49B Ni catalyst at 500 psig hydrogen pressure, 350°-375° F. over a three to four hour period.

EXAMPLES

The process of the present invention is further exemplified by the following Examples.

Example 1

Traction fluid was prepared by oligomerizing beta-pinene using HZSM-5B zeolite catalyst. The HZSM-5B catalyst has a pore size of 5.4 to 5.6 Å, a crystal size of 0.02 to 0.1 microns.

One hundred grams of beta-pinene, freshly percolated through activated alumina, and ten grams of HZSM-5B powder were charged into a 450 ml Parr reactor equipped with a gas inlet, a stirrer and a sampling outlet. The reactor was closed, purged with nitrogen and slowly heated to 150° C. The reaction was exothermic and only a mild external heating was sufficient to bring the reaction to 150° C. The reaction was carried out at a temperature of 150° C. and moderate pressure of 10 to 50 psig (0.068 to 0.34 Kpa) for 88.5 hours. The products were analyzed by gas chromatographic analysis. The products contained 22.1% $C_{10}$ monomers, 59.9% $C_{20}$ dimers, 15.2% $C_{30}$ trimers and 2.8% $C_{40}$ tetramers of beta-pinene. The monomers were removed by distillation. The remaining lube oil fraction boiled at a temperature of 600° to 1000° F., had a viscosity at 212° F. of 9.8 cS and a viscosity index of −217.

Traction measurement was made on a ball-on-plate traction apparatus. Shear strength measurements of the lube oil traction showed that it had a traction coefficient of 0.102 at 90° C. and 400 Kpsi maximum contact stress.

Example 2

Traction fluid was prepared using beta-pinene and the HZSM-5B zeolite catalyst of Example 1.

Three hundred grams of beta-pinene, freshly percolated through activated alumina, and 30 grams of HZSM-5B powder were charged to a 450 ml Parr reactor. The reactor was closed, purged with nitrogen and slowly heated to 100° C. The reaction was carried out at a temperature of 100° C. and moderate pressure of 10 to 50 psig (0.068 to 0.34 Kpa) for 88.8 hours after which the products were analyzed by gas chromatography analysis. The product contained 56.1% $C_{10}$ monomer, 37.7% $C_{20}$ dimers, 5.2% $C_{30}$ trimers, and 1.0% $C_{40}$ tetramers of beta pinene. The dimers were separated by distillation (B.P. 110° C./0.6 Torr.). The $C_{20}$ dimer fraction boiled at a temperature of 600° to 700° F., had a viscosity at 212° F. of 4.04 and a viscosity index of −186. Traction measurement was made as before and showed that the $C_{20}$ dimers had a traction coefficient of 0.097 at 90° C. and 400 Kpsi maximum contact stress.

Example 3

The Example 1 was repeated. The $C_{20}$ dimer portion of the product was separated by distillation and boiled at a temperature of 600° to 700° F. The $C_{20}$ dimer portion was hydrogenated and produced a water-white liquid. The hydrogenation reaction was carried out over a Ni hydrogenation catalyst at a temperature of about 450° F. (232° C.) at a hydrogen pressure of 40 psig (0.27 Kpa) for 8 hours.

The hydrogenated product had a viscosity at 212° F. of 3.94 cS, a viscosity index of −160 and an extremely high traction coefficient of 0.111 at 90° C. and 400 Kpsi maximum contact stress.

Example 4

Traction fluid was prepared by copolymerizing beta-pinene and isobutylene using HZSM-5B zeolite catalyst. HZSM-5B catalyst was mixed with alumina binder (65% HZSM-5B and 35% $Al_2O_3$) to prepare 1/16 inch×0.1 to 0.5 inch extrudates. The HZSM-5B contained $SiO_2$:$Al_2O_3$ ratio of 70:1. The HZSM-5B had a pore size of 5.4–5.6 A, a crystal size of 0.02 to 0.1 microns.

A mixture of 85.2 grams of beta-pinene freshly percolated through active alumina and 37.3 grams of isobutylene (mole ratio 1:1) were copolymerized over 13 grams of the HZSM-5B pellets. The reaction was carried out at a temperature of 230° C. and moderate pressure of 10 to 50 psig for 95 hours. The product contained 31% 650° F.+ lube oil.

The 650° F.+ lube oil was separated by distillation and had a viscosity at 212° F. of 10.73 cS, a viscosity index of −291 and a high traction coefficient estimated to be about 0.105 at 90° C. and 400 Kpsi maximum contact stress.

Example 5

The Example 1 was repeated except that the feed used was alpha-pinene. The $C_{20}$ dimer portion of the product was separated by distillation and boiled at a temperature of 600° to 700° F. The $C_{20}$ dimer portion was hydrogenated and produced a water-white liquid. The hydrogenation reaction was carried out over a Ni hydrogenation catalyst at a temperature of about 450° F. (232° C.) at a hydrogen pressure of 44 psig (0.30 Kpa) for 24 hours.

The hydrogenated product had a viscosity at 212° F. of 3.94 cS, a viscosity index of −207.6 and a high traction coefficient estimated to be about 0.110 at 90° C. and 400 Kpsi maximum contact stress.

Example 6

Traction fluid was prepared by oligomerizing limonene using HZSM-5B zeolite catalyst of Example 1.

One hundred grams of limonene, freshly percolated through activated alumina, and ten grams of HZSM-B powder were charged into a 450 ml Parr reactor. The reactor was closed, purged with nitrogen and heated to a temperature of 150° C. The reaction was carried out at a temperature of 150° C. and moderate pressure of 10 to 50 psig (0.068 to 0.34 Kpa) for 88.5 hours. The product was analyzed by gas chromatographic analysis. The product contained 20.5% $C_{10}$ monomers, 61.0% $C_{20}$ dimers, 16.5% $C_{30}$ trimers and 2.0% $C_{40}$ tetramers of limonene. The $C_{20}$ dimers were removed by distillation and boiled at a temperature of 600° to 700° F. The $C_{20}$ dimer portion was hydrogenated and produced a water-white liquid. The hydrogenation reaction was carried out over a Ni hydrogenation catalyst at a temperature of 450° F. (232° C.) at a hydrogen pressure of 45 psig (0.31 Kpa) for 84 hours.

The hydrogenated product had a viscosity at 212° F. of 4.01 cS, a viscosity index of −265 and a high traction coefficient of 0.108 at 90° C. and 400 Kpsi maximum contact stress.

Example 7

Traction fluid was prepared by oligomerizing beta-pinene using the HZSM-5B extrudate pellets of Example 4.

Two hundred grams of beta-pinene, freshly percolated through activated alumina and 20 grams of the 65% HZSM-5B extrudate pellets were charged into a 450 ml Parr reactor. The reactor was closed, purged with nitrogen and heated to a temperature of 200° C. The reaction was carried out at a temperature of 200° C. and a moderate pressure of 10–50 psig (0.068 to 0.34 Kpa) for 137 hours. Samples were taken at intervals and analyzed by gas chromatography for products boiling above 650° F.+. At the end of the 137 hour reaction time 40% of the product boiled at 650° F.+. The product after removal of the catalyst was distilled to remove the 650° F.− fraction.

The 650° F.+ fraction contained dimers and trimers of beta-pinene, had a viscosity at 212° F.+ of 7.52 cS, a viscosity index of −686 and a high traction coefficient of 0.098 at 90° C. and 400 Kpsi maximum contact stress.

The bicyclic and monocyclic terpene derived traction fluids of the present invention have very good traction properties relative to those that are currently available from naphthenic stocks. The traction fluids of the present invention though comparable to the commercially available traction fluids are much more economical to produce.

Having thus generally described the present invention and discussed the preferred embodiments in support thereof, it is to be understood that no undue restrictions are to be imposed by reason thereof except as defined by the following claims.

What is claimed is:

1. A process for the production of a 600° F.+ lube oil traction fluid from bicyclic or monocyclic terpene which comprises reacting said bicyclic or monocyclic terpene over medium pore acid zeolite catalyst at elevated temperature and obtaining a high boiling liquid product comprising dimer or trimer, respectively, of said bicyclic or monocyclic terpene.

2. The process of claim 1 wherein the reaction is carried out at a temperature of 122° to 392° F. and pressure of about 10 to 50 psig, wherein said zeolite catalyst has the structure of H-ZSM-5; and further hydrogenating said dimer or trimer.

3. The process of claim 1 wherein the dimer or trimer boil in the range of 600° to 1000° F.

4. A process for the production of a high traction coefficient lube oil from bicyclic or monocyclic terpene which comprises contacting said bicyclic or monocyclic terpene over acid ZSM-5 zeolite catalyst at elevated temperatures and pressures; obtaining a high boiling liquid product comprising dimer or trimer, respectively, of said bicyclic or monocyclic terpene; and separating said monomers from said dimer or trimer, wherein said dimer or trimer have a high traction coefficient.

5. The process of claim 4 wherein the reaction is carried out at a temperature of 167° to 392° F. and a pressure of 10–50 psig.

6. The process of claim 4 wherein the dimer or trimer boil in the range of 600° to 900° F.

7. The process of claim 4 wherein the bicyclic or monocyclic terpene feed space velocity is 0.05 to 5.0 WHSV.

8. The process of claim 4 wherein the bicyclic terpene is a member selected from the group consisting of alpha-pinene, beta-pinene and camphene and has the following structural formula

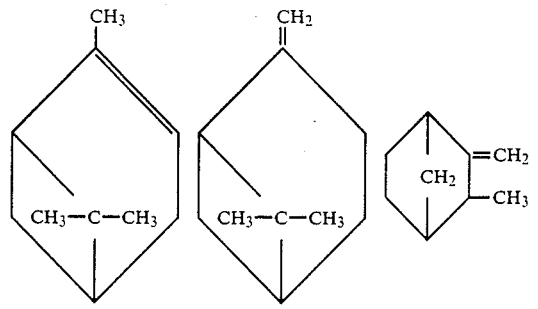

α-Pinene β-Pinene Camphene

9. The process of claim 4 wherein the monocyclic terpene is a member selected from the group consisting of alpha-terpinene, beta-terpinene and limonene and has the following structural formula

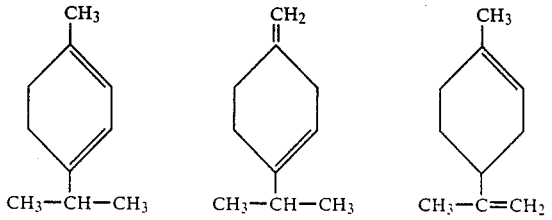

α-Terpinene β-Terpinene Limonene

10. The process of claim 4 wherein the zeolite catalyst is HZSM-5 catalyst.

11. A process for the production of a 650° F.+ lube oil traction fluid from bicyclic or monocyclic terpene which comprises copolymerizing said bicyclic or monocyclic terpene with light olefin over a medium pore acid zeolite catalyst at elevated temperatures to obtain a high boiling lube oil product and separating a 650° F. lube oil traction fluid fraction from said high boiling lube oil product.

12. The process of claim 11 wherein the reaction is carried out at a temperature of 122° to 392° F.

13. The process of claim 11 wherein the bicyclic or monocyclic terpene and the light olefin are copolymerized at a mole ratio of terpene to olefins of 3:1 to 1:3.

14. The process of claim 11 wherein the light olefin is a member selected from the group consisting of propylene and butylene.

15. A 650° F.+ lube oil traction fluid comprising a copolymer of a bicyclic terpene and a light olefin.

16. The lube oil traction fluid of claim 15 wherein the light olefin is a member selected from the group consisting of propylene and butylene.

17. The lube oil traction fluid of claim 15 wherein the lube oil has a high traction coefficient of 0.090 to 0.120.

18. A 650° F.+ lube oil traction fluid comprising a copolymer of a monocyclic terpene and a light olefin.

19. The lube oil traction fluid of claim 18 wherein the light olefin is a member selected from the group consisting of propylene and butylene.

20. The lube oil traction fluid of claim 18 wherein the lube oil has a high traction coefficient of 0.090 to 0.120.

* * * * *